United States Patent [19]

Lester

[11] Patent Number: 4,699,195

[45] Date of Patent: Oct. 13, 1987

[54] COLLAPSIBLE BLIND FOR SEMI-CIRCULAR ARCHED WINDOW

[76] Inventor: Lance Lester, 9509 N. 13 St., Phoenix, Ariz. 85020

[21] Appl. No.: 861,923

[22] Filed: May 12, 1986

[51] Int. Cl.[4] ..... E06B 3/92

[52] U.S. Cl. ..... 160/134; 160/DIG. 3

[58] Field of Search ..... 160/134, 166 R, 130, 160/DIG. 3; 296/97 C, 97 G

[56] References Cited

U.S. PATENT DOCUMENTS

| | | | |
|---|---|---|---|
| 602,967 | 4/1898 | Wells | 160/134 |
| 1,447,189 | 3/1923 | Simon | 160/134 X |
| 1,450,142 | 3/1923 | Dietrich | 160/134 X |
| 1,510,984 | 10/1924 | Dorsey et al. | 296/97 G |
| 1,609,877 | 12/1926 | Kendall | 160/134 X |
| 1,617,981 | 2/1927 | Allen | 296/97 G |
| 2,517,281 | 8/1950 | Brown | 160/134 X |
| 4,332,414 | 6/1982 | Surtin | 296/97 G |
| 4,606,572 | 8/1986 | Maguire | 160/DIG. 3 |

FOREIGN PATENT DOCUMENTS

| | | | |
|---|---|---|---|
| 815405 | 6/1959 | United Kingdom | 160/134 |

*Primary Examiner*—Ramon S. Britts
*Assistant Examiner*—David M. Purol
*Attorney, Agent, or Firm*—Henry M. Bissell

[57] ABSTRACT

A blind for installation adjacent the semi-circular portion of.an arched window is disclosed which is based on a U-shaped frame, which frame is adapted for mounting along the face of the window at the bottom of the semi-circular portion thereof. Two sets of blades fan out evenly from the ends of the U-shaped frame around an axis and meet at the top of the window, thereby forming a semi-circular array. Handles rotating from the blade axis are fastened onto the last blade in each set, and meet at the top where they are locked into position by latches mounted on the end of a support arm also rotating from the blade axis.

13 Claims, 7 Drawing Figures

20
18
16
14
10
16
14
18
10

16a
15
14a
20a
18a
10
36a
44
46
32a
40
36
24n

12

32
22n
32
40
36
22l
22m
22n
24n
24m
24l
22j
22k
24k
24j 22i
24i
22h
24h
22g
24g
22f
30
34
24f
22e
24e
22d
24d
22c
24c
22b
24b
22a
24a
10
26
14

COLLAPSIBLE BLIND FOR SEMI-CIRCULAR ARCHED WINDOW

BACKGROUND OF THE INVENTION

1. Field of the Invention

The present invention relates generally to a blind for use in windows to prevent direct sunlight from passing therethrough and, more particularly, to a collapsible blind for convenient installation in a semi-circular arched window, which blind may be easily unfolded and set up to present an attractive and functional window dressing.

2. Description of the Prior Art

Venetian blinds have been in use for some time to prevent direct sunlight from entering a house or other building, while allowing the entrance of sufficient light to fully illuminate the interior of the building, as well as to assure privacy of those within a room from the sight of a person outside who might try to look in. Venetian blinds are typically made of a plurality of parallel rectangular slats or blades, each of which is supported by one of the rungs of a ladder-shaped fabric segment installed at each end of the blades. By raising one side of each of the ladder-shaped fabric segments, the blades may all be simultaneously adjusted to prevent the passage of direct sunlight while allowing a variable amount of indirect light to pass therethrough.

Due to the design of such blinds, they are limited to an essentially rectangular configuration. With the popularity of the Victorian style house at the turn of the century, and the art deco style of the twenties, arched windows were a popular choice in construction. With the prevalence of such windows came the desire to cover them, at least to prevent the passage of direct sunlight therethrough. While the lower rectangular portion could easily and conveniently be covered by standard blinds or shades, the upper semi-circular portion of the arched window was not so easily covered.

With the renewed popularity of both Victorian and art deco architecture, the arched window has come back into style. With the increase in popularity of the arched window has come a substantial demand for a blind designed to fit the semi-circular arched portion of the window.

As might be expected, a number of solutions to the problem were invented during the arched window's earlier popularity, with one of the earliest examples being U.S. Pat. No. 602,967, to Wells. Wells discloses a complex and ambitious device designed to operate in a substantially similar manner to Venetian blinds, with sets of fan-like blades on both sides rising to meet in the center. The complexity of the Wells device makes it difficult and expensive to manufacture, as well as difficult to operate. In addition, since the Wells blind has two sets of blades mounted on different pivot points, and a continuous band around the edge, it is not graceful in appearance and would be difficult to market successfully today.

Other attempts to provide window dressing for an arched window were mainly shades rather than blinds. Examples of such shades are found in U.S. Pat. No. 1,447,189, to Simon, and U.S. Pat. No. 1,609,877, to Kendall. Unfortunately, shades typically allow only diffused light to pass therethrough, and are therefore undesirable to those who only wish to inhibit the passage of direct sunlight through the windows. For this reason, blinds represent a highly desirable solution while shades represent only a partial solution at best.

It may thus be seen that it is desirable to have a semi-circular blind which may be used for arched windows. It is also desirable that the blind be of a relatively simple mechanical design, therefore not presenting the substantial disadvantages of the Wells blind.

It has been established that most people would not even change the position of a blind covering the arched portion of a window, but rather would place the blind in a position which blocks direct sunlight. Therefore, it is only necessary that a blind for the semi-circular portion of an arched window have one position—namely the position preventing the entry of direct sunlight. Accordingly, it is an object of the present invention to provide a substantially fixed blind for use with the semi-circular portion of an arched window.

It is also desirable that the invention be mounted about a single pivot point for aesthetic enhancement and simplicity in operation. The invention should also be easily installable, without substantial difficulty or the requirement of other than simple hand tools. Finally, it is desirable that the present invention be as inexpensive as possible while solving the aforementioned problems, and that it provide no substantial disadvantages when used.

SUMMARY OF THE INVENTION

The present invention represents an advantageous solution to the problems mentioned above. A frame is provided for mounting into the arched window at the bottom of the semi-circular portion of the window. The frame supports a plurality of blades which fan out from a common axis of rotation. Half of the blades fan out from one end of the frame, and the other half of the blades fan out from the other end of the frame, with the blades meeting at the top of the semi-circular portion of the arched window. Each group of blades is connected near the end opposite the axis of rotation in sequence to a cord allowing an identical separation of the blades.

Each set of half of the blades has a handle connected to the blade farthest from the end of the frame from which the blades fan out. The handles are also rotatably mounted around the same axis and at the front of the blind, with the end of the handle away from the axis of rotation being connected to the end of the last blade away from the axis of rotation. A pair of latches is mounted on the end of a support arm extending from the same axis at the back of the blind. The ends of the handles away from the axis of rotation are secured to the latches in the support arm, completing the assembly of the blind. Alternatively, the latches may be mounted on the wall at the top of the window for retaining the blind in the closed position.

The blades may also have a variable degree of twist therein, depending on the amount of light the blind is to admit. By twist, it is meant that the edge of the blade at one end is angularly displaced from the edge at the other end of the blade. If the blades have little or no twist along their length they will admit virtually no light. On the other hand, if they have a great amount of twist, they will admit an amount of light proportionate to the degree of twist therein. The twist may be substantially at one location near the end of the blades fastened to the bolt, or it may be gradual along the length of the blade.

It will be appreciated that the blind of the present invention advantageously satisfies the objectives enumerated above, and with no substantial disadvantage whatsoever. The blind may be shipped in a collapsed position, and easily brought to its assembled position without the need for any tools whatsoever. In fact, the only need for a tool is for a screwdriver to fasten the mounting brackets to the window casing.

The blind of the present invention neatly fits the semi-circular arched window shape, and effectively prevents the passage of direct sunlight therethrough. Due to the construction of the present invention, it may be appreciated that it is relatively inexpensive to manufacture, and that it presents no difficult mechanical operation which would require particularly close tolerances. Finally, and notably as far as marketing such a blind is concerned, its single pivot point renders the assembled and installed blind aesthetically pleasing, making it a desirable accessory for arched windows.

DESCRIPTION OF THE DRAWINGS

A better understanding of the present invention may be had from a consideration of the following detailed description, taken in conjunction with the accompanying drawings in which.

DETAILED DESCRIPTION OF THE PREFERRED EMBODIMENT

Figures 1, 2, 2A, 3, 4, 6:
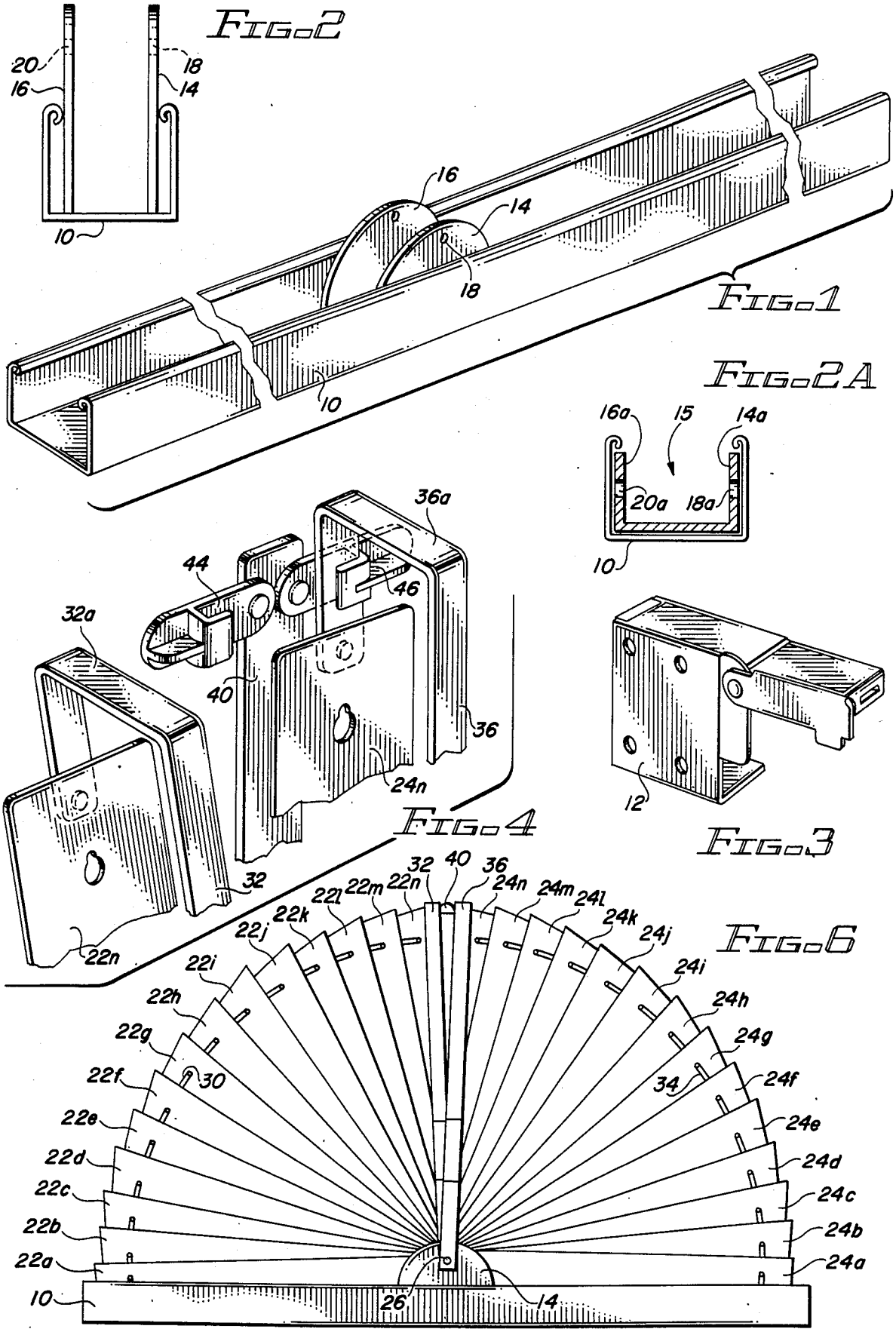
FIG. 1 is a perspective view of the U-shaped channel frame and the two support portions mounted thereon.
FIG. 2 is an end view of the U-shaped channel and the two support portions illustrated in FIG. 1.
FIG. 2A shows an alternative to the arrangement of FIG. 2.
FIG. 3 is a perspective view of one of the brackets used to mount the U-shaped channel shown in FIGS. 1 and 2 adjacent an arched window casing.
FIG. 4 is a partial perspective view of the ends of the handles used to bring the blades into position, the support arm, and the latches on the support arm used to secure the handles and the blades in an open position for one embodiment of the invention.
FIG. 6 is a front view of the blind of FIG. 5 in an open and locked position.

As shown in FIGS. 1 and 2, the preferred embodiment of the present invention uses as a simple frame a segment of standard two-inch by two-inch U-shaped steel channel 10 which will be mounted at the bottom of the semi-circular portion of an arched window with the open side of the U-shaped channel 10 facing upward. The U-shaped channel 10 is mounted to the window casing (not shown) using a pair of standard blind support brackets, the installation of which is well known. One of the brackets 12 is shown in FIG. 3. Referring again to FIG. 1, the length of the U-shaped channel 10 will of course depend on the size of the window the blind is to be installed in, with the length of the U-shaped channel 10 usually being slightly greater than the diameter of the semi-circular portion of the arched window for installation on the face of the wall in which the window is positioned.

The semi-circular support pieces 14, 16 made of steel are installed in the interior of the U-shaped channel 10 at the center thereof, with one support portion 14 mounted on the interior of the front side of the U-shaped channel 10 and extending therefrom, and the other support portion 16 mounted on the interior of the back side of the U-shaped channel 10. The support portions 14, 16 are thus parallel to each other and centrally located in the U-shaped channel 10, and have a space therebetween and partially within the U-shaped channel 10, as best shown in FIG. 2.

The support portions 14, 16 are approximately semi-circular in shape in the preferred embodiment, with the shape being essentially a pleasing or aesthetic configuration when viewed with the rest of the device when installed in a window. The support portions 14, 16 have apertures 18, 20, respectively, therethrough, with the apertures 18 and 20 being axially aligned and defining an axis of rotation. Alternatively, as shown in FIG. 2A, the pieces **14*a*, 16*a* may comprise the side portions of a U-shaped member of hub 15 which is situated within the channel 10, thereby providing structural reinforcement to the channel, and having apertures 18*a* and 20*a* recessed below the upper edges of the channel 10**.

Figure 5:
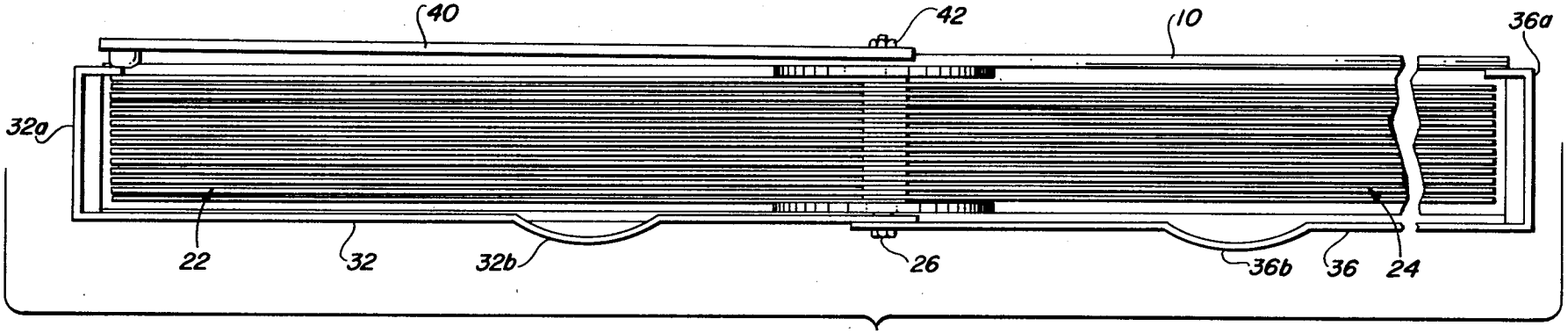
FIG. 5 is a top view of the blind of the present invention in an unopened position.

As shown in FIGS. 5 and 6, two sets of blades 22, 24 are movably mounted between the support portions 14, 16 by a pivot member in the form of a bolt 26 passing through one end of each blade in the first and second sets of the blades 22, 24 and the apertures 18, 20 in the support portions 14, 16. All of the blades in the first and second sets of blades 22, 24 are thereby mounted between the support portions 14, 16, with successive blades going alternatively toward one end or the other of the U-shaped channel 10. The blades are typically made of metal such as steel or aluminum.

In the embodiment shown in the figures, each of the two sets of blades 22, 24 contains 14 individual blades. The first set of blades 22, which are located on the left side of the U-shaped channel 10, includes blades **22*a*–22*n*, and the second set of blades 24, which are located on the right side of the U-shaped channel 10, includes blades 24*a*–24*n*. It will, of course, be recognized that different numbers of blades could be included in the first and second sets of blades 22, 24**, without departing from the spirit of the invention. Larger size windows will require more blades, while smaller windows can be served with fewer blades.

The blades in the two sets of blades 22, 24 are mounted on the bolt 26 in alternating sequence between the support portions 14, 16, in the order **24*a*, 22*a*, 24*b*, 22*b*, 24*c*, 22*c*, etc. The blades in the first set of blades 22 are fastened together with a first length of ribbon or tape 30 such that there are equal distances between successive blades in the first set of blades 22, with the blade 22*a* at the front of the blind being fastened to the U-shaped channel 10 by the tape 30 or by other means known in the art. The use of the tape 30 is as known in the art to separate succeeding blades by a desired distance, and the blades typically contain two adjacent differing size holes such as those shown in the blades 22*n* and 24*n* in FIG. 4. The tape 30** is connected to the blades typically by light rivets, such as is used in leather work.

The blades in the first set of blades 22 may thus fan out evenly, with the last blade **22*n* reaching a position approximately 90° from the left end of the U-shaped channel 10 with the tape 30 drawn tight between the blades in the first set of blades 22. The last blade 22*n* has its end away from the axis of rotation fastened to a handle 32 which also rotates about the bolt 26. The handle 32 has a U-shaped segment 32*a* at the end removed from the axis of rotation, which U-shaped segment 32*a* goes around the blades in the first set of blades 22 to reach to the back side of the last blade 22*n* at the end of the last blade 22*n*** away from the axis of rotation.

The handle 32 is then riveted to the end of the last blade 22*n* at the point of contact.

It may thus be appreciated that when the first set of blades 22 are collapsed into the left side of the U-shaped channel 10 as shown in FIG. 5, by moving the handle 32 in a clockwise direction the first set of blades 22 is fanned out evenly. The handle 32 contains a grip portion 32*b* which may be conveniently gripped without contacting the blades in the first set of blades 22.

Likewise, the blades in the second set of blades 24 are fastened together with a second length of tape 34 such that there are equal distances between successive blades in the second set of blades 24, with the blade 24*a* at the front of the blind being fastened to the U-shaped channel 10. The tape 34 functions as does the tape 30 to separate succeeding blades in the second set of blades 24 by a desired distance. The tapes 30, 34 preferably comprise lengths of flat webbing about ⅜ inch wide.

The blades in the second set of blades 24 may thus also fan out evenly, with the last blade 24*n* reaching a position approximately 90° from the right end of the U-shaped channel 10 with the tape 34 drawn tight between the blades in the second set of blades 24. The last blade 24*n* has its end away from the axis of rotation fastened to a handle 36 which also rotates about the bolt 24. The handle 36 has a U-shaped segment 36*a* at the end removed from the axis of rotation, which U-shaped segment 36*a* goes around the blades in the second set of blades 24 to reach to the back side of the last blade 24*n* at the end of the last blade 24*n* away from the axis of rotation. The handle 36 is then riveted to the end of the last blade 24*n* at the point of contact.

The second set of blades 24 is collapsed into the right side of the U-shaped channel 10 as shown in FIG. 5, and by moving the handle 36 in a counterclockwise direction the second set of blades 24 is fanned out evenly. The handle 36 also contains a grip portion 36*b* which may be conveniently gripped without contacting the blades in the second set of blades 24.

A support arm 40 is also rotatably mounted on said bolt as it passes through the hole 20 in back support portion 16, and the bolt is secured with a nut 42. A pair of latches 44, 46 are fastened to the support arm 40 at the end away from the axis of rotation. The latch 44 extends to the left side of the support arm 40 when the support arm 40 is directed at a 90° angle from the U-shaped channel 10, and the latch 46 extends to the right side of the support arm 40.

The U-shaped portion 32*a* of the handle 32 may be secured into the latch 44 by slightly stretching the tape 30, which will by tension therein retain the U-shaped portion 32*a* in the latch 44. Likewise, the U-shaped portion 36*a* of the handle 36 may be secured into the latch 46 by slightly stretching the tape 34, which will by tension therein retain the U-shaped portion 36*a* in the latch 46, completing assembly of the device.

The various components of the blind disclosed herein may be painted prior to assembly. As may be apparent, the blind is shipped collapsed as shown in FIG. 5. The blades of the device may be relatively flat, and if so, the blind will let relatively little light, direct or indirect, pass therethrough. The blades may, however, have a variable degree of twist therein depending on the amount of light the blind is to admit. The twist enables the edge of the blades at one end to be angularly displaced from the edge at the other end of the blades. If the blades have little or no twist along their length they will admit virtually no light. On the other hand, if they have a great amount of twist, they will admit a quantity of light proportionate to the degree of twist therein. The twist may be substantially at one location near the end of the blades fastened to the bolt 26, or it may be gradual along the length of the blades, depending on the particular effect desired.

The device as disclosed above provides significant advantages with no relative disadvantage at all. The blind may be shipped collapsed, and easily brought to its assembled position without the use of tools. Only a screwdriver is needed to fasten the mounting brackets to the window casing. The blind of the present invention neatly fits along the face of the semi-circular arched window shape, and effectively prevents the passage of direct sunlight therethrough. It is relatively inexpensive to manufacture, and presents no difficult mechanical operation which would require particularly close tolerances. Also, its single pivot point renders the assembled and installed blind aesthetically pleasing, making it a desirable accessory for arched windows.

Although there have been described above specific arrangements of a collapsible blind for semi-circular arched window in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A collapsible blind for use with an arched window having a semi-circular portion at the top thereof, comprising:

a U-shaped channel for mounting along the face of said window at the bottom of said semi-circular portion thereof with the open side of said U-shaped channel facing upward, said U-shaped channel thereby having two sides and a bottom;

a first support portion installed in the interior of said U-shaped channel on one side thereof and at the center thereof, said first support portion having an aperture therethrough;

a second support portion installed in the interior of said U-shaped channel on the other side thereof and at the center thereof, said second support portion having an aperture therethrough, said first and second support portions defining a space therebetween, and said apertures defining an axis of rotation;

a pivot member extending through said apertures in said first and second support portions;

a first set of blades rotatably mounted on said pivot member between said first and second support portions, said first set of blades extending toward one end of said U-shaped channel;

a first tape extending between successive ones of said first set of blades for allowing said first set of blades to fan out;

a second set of blades rotatably mounted on said pivot member between said first and second support portions, said second set of blades extending toward the other end of said U-shaped channel;

a second tape extending between successive ones of said second set of blades for allowing said second set of blades to fan out;

first means for moving said first set of blades from a collapsed position within said one end of said channel to an open position;

second means for moving said second set of blades from a collapsed position within said other end of said channel to an open position; and means for securing said first and second sets of blades in an open position;

wherein the blade in said first set of blades closest to said first support portion is the first blade in said first set of blades, the blade in said first set of blades closest to said second support portion is the last blade in said first set of blades, the blade in said second set of blades closest to said first support portion is the first blade in said second set of blades, and the blade in said second set of blades closest to said second support portion is the last blade in said second set of blades, said first blade in said first set of blades is attached to said U-shaped channel at one end thereof, and said first blade in said second set of blades is attached to said U-shaped channel at the other end thereof;

wherein said first means for moving comprises a first handle rotatably secured by said pivot member on the side of said first support portion away from said first and second set of blades, said first handle extending around said first set of blades and being attached to said last blade in said first set of blades, and said second means for moving comprises a second handle rotatably secured by said pivot member on the side of said first support portion away from said first and second set of blades, said second handle extending around said second set of blades and being attached to said last blade in said second set of blades;

wherein said pivot member comprises a bolt having a head at one end and a nut threaded on the other end, said bolt and nut retaining the blades and handles assembled in position relative to said support portions; and wherein said means for securing comprises a support arm rotatably secured by said bolt on the side of said second support portion away from said first and second set of blades, said support arm having at the free end thereof a pair of latches for securing said first and second handles in a position whereby said first and second set of blades are fully fanned out.

2. A collapsible blind as defined in claim 1 wherein said U-shaped channel is made of standard two-inch by two-inch steel channel.

3. A collapsible blind as defined in claim 1 wherein said first and second support portions are made of steel and are essentially semi-circular in configuration.

4. A collapsible blind as defined in claim 1 wherein said U-shaped channel is mounted to said window using a pair of standard blind support brackets.

5. A collapsible blind as defined in claim 1 wherein said blades are made of a metal from the group comprising steel and aluminum.

6. A collapsible blind as defined in claim 1 wherein said first blade in said first set of blades is attached to said U-shaped channel at said one end thereof by said first tape, and said first blade in said second set of blades is attached to said U-shaped channel at the other end thereof by said second tape.

7. A collapsible blind as defined in claim 1 wherein said last blade in said first set of blades is approximately 90° away from said one end of said U-shaped channel when said first set of blades is fanned out, and said last blade in said second set of blades is approximately 90° away from said other end of said U-shaped channel when said second set of blades is fanned out.

8. A collapsible blind as defined in claim 1 wherein said first handle includes a grip portion for conveniently gripping said first handle without contacting the blades in said first set of blades, and said second handle also includes a grip portion for conveniently gripping said second handle without contacting the blades in said second set of blades.

9. A collapsible blind as defined in claim 1 wherein said first handle is secured into one of said latches by slightly stretching said first tape, which first tape by tension will retain said first handle in said one of said latches, and wherein said second handle is secured into the other of said latches by slightly stretching said second tape, which second tape by tension will retain said second handle in said other of said latches.

10. A collapsible blind as defined in claim 1 wherein said blades are twisted whereby the edge of the blades at one end are angularly displaced from the edge of the blades at the other end, thereby permitting the blind to admit indirect light.

11. A collapsible blind as defined in claim 1 wherein the blades of said first and second set of blades are installed on said pivot member in alternating fashion, with a blade from said first set of blades being followed by a blade from said second set of blades, and vice versa.

12. A collapsible blind as defined in claim 1 wherein said first and second support portions comprise side portions of a U-shaped support member mounted within the U-shaped channel as a stiffener therefor.

13. A collapsible blind for use in a building with an arched window having a semi-circular portion at the top thereof, comprising:

a U-shaped channel for mounting along said window at the bottom of said semi-circular portion thereof with the open side of said U-shaped channel facing upward, said U-shaped channel thereby having a front side facing the interior of the building and a back side facing the exterior of the building;

a first support portion made of steel and installed in the interior of said U-shaped channel on one side thereof and at the center thereof, said first support portion having an aperture therethrough;

a second support portion made of steel and installed in the interior of said U-shaped channel on the back side thereof and at the center thereof, said second support portion having an aperture therethrough, said first and second support portions having a space therebetween, and said apertures defining an axis of rotation;

a bolt extending through said apertures in said first and second support portions;

a first set of blades each having an aperture at one end thereof for mounting on said bolt between said first and second support portions, the blade in said first set of blades closest to said first support portion being said first blade in said first set of blades, the blade in said first set of blades closest to said second support portion being said last blade in said first set of blades;

a first tape extending between successive ones of said first set of blades for allowing said first set of blades to fan out, said first blade in said first set of blades being attached to said U-shaped channel at one end thereof, said last blade in said first set of blades being approximately 90° away from said one end of said U-shaped channel when said first set of blades are fanned out;

a second set of blades each having an aperture at one end thereof for mounting on said bolt between said first and second support portions, the blade in said second set of blades closest to said first support portion being said first blade in said second set of blades, the blade in said second set of blades closest to said second support portion being said last blade in said second set of blades;

a second tape extending between successive ones of said second set of blades for allowing said second set of blades to fan out, said first blade in said second set of blades being attached to said U-shaped channel at the other end thereof, said last blade in said second set of blades being approximately 90° away from said other end of said U-shaped channel when said second set of blades are fanned out;

a first handle rotatably secured by said bolt on the side of said first support portion away from said first and second set of blades, said first handle extending around said first set of blades and being attached to said last blade in said first set of blades;

a second handle rotatably secured by said bolt on the side of said first support portion away from said first and second set of blades, said second handle extending around said second set of blades and being attached to said last blade in said second set of blades; and a support arm rotatably secured by said bolt on the side of said second support portion away from said first and second set of blades, securing said first and second handles in a position whereby said first and second sets of blades are fully fanned out.

* * * * *